US006212729B1

(12) United States Patent
Weichelt et al.

(10) Patent No.: US 6,212,729 B1
(45) Date of Patent: Apr. 10, 2001

(54) FABRIC WET MOP

(75) Inventors: Joel C. Weichelt, Kewaunee; Yvonne M. Louison, Algoma, both of WI (US)

(73) Assignee: East Shore Industries, Inc., Algoma, WI (US)

( * ) Notice: Subject to any disclaimer, the term of this patent is extended or adjusted under 35 U.S.C. 154(b) by 0 days.

(21) Appl. No.: 09/348,856

(22) Filed: Jul. 7, 1999

(51) Int. Cl.[7] ..... A47L 13/20

(52) U.S. Cl. ..... 15/228; 15/229.1; 15/229.2; 15/244.3; 15/247

(58) Field of Search ..... 15/228, 229.1–229.9, 15/247, 244.3

(56) References Cited

U.S. PATENT DOCUMENTS

| | | | | |
|---|---|---|---|---|
| 333,372 | * | 12/1885 | Wilson | 15/228 |
| D. 362,939 | | 10/1995 | Reno | D32/51 |
| D. 375,391 | | 11/1996 | Williams et al. | D32/50 |
| 1,127,875 | * | 2/1915 | Ellis | 15/228 |
| 1,210,841 | * | 1/1917 | Reilly | 15/228 X |
| 1,437,145 | * | 11/1922 | Johnson | 15/229.3 X |
| 2,524,192 | * | 10/1950 | Harget | 15/228 |
| 2,546,505 | * | 3/1951 | Heron | 15/247 |
| 2,671,919 | * | 3/1954 | Kelley | 15/228 X |
| 3,966,259 | | 6/1976 | Richards | 300/21 |
| 3,981,040 | | 9/1976 | Crofton | 15/229.2 |
| 4,582,210 | | 8/1989 | Krajicek | 15/228 |
| 4,945,599 | | 8/1990 | Flynn | 15/244.3 |
| 5,042,105 | | 8/1991 | Buck et al. | 15/247 |
| 5,177,831 | | 1/1993 | Wirth | 15/244.3 |
| 5,343,587 | | 9/1994 | Findley | 15/228 |
| 5,784,746 | | 7/1998 | Williams et al. | 15/118 |

* cited by examiner

*Primary Examiner*—Mark Spisich
(74) *Attorney, Agent, or Firm*—Andrus, Sceales, Starke & Sawall, LLP

(57) ABSTRACT

A mop head for cleaning floors and the like includes a pair of fabric covering elements enclosing the strands of a looped-end wet mop. The fabric covering elements are of a generally trapezoidal shape with a narrow end at the top and a wider end at the bottom. The narrow end is open for insertion of the strands, while the wider end may be open or closed. The fabric covering elements enclose each end of the strands. A headband is attached to the central portion of the mop head around the open ends of the fabric covering elements enclosing the strands. Alternatively, the mop head may be made solely of two fabric mopping elements secured to and extending from each end of a headband, or two fabric pouches having absorbent filler material inserted therein and attached to a central headband to form a fabric wet mop.

17 Claims, 4 Drawing Sheets

FIG. 3
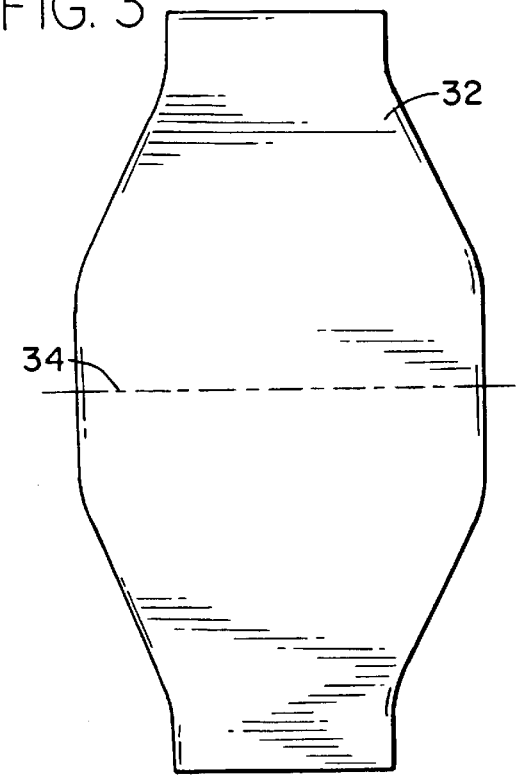
FIG. 4
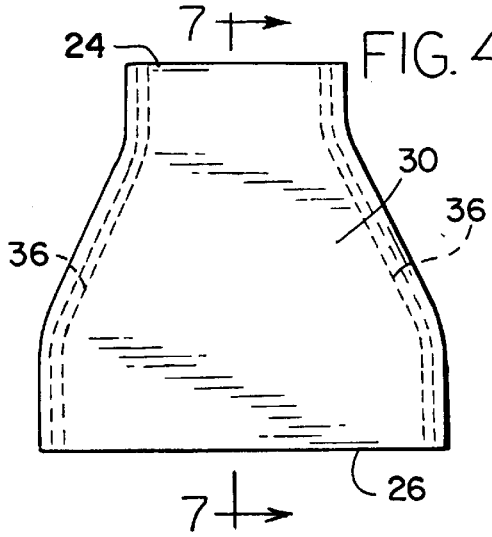
FIG. 6
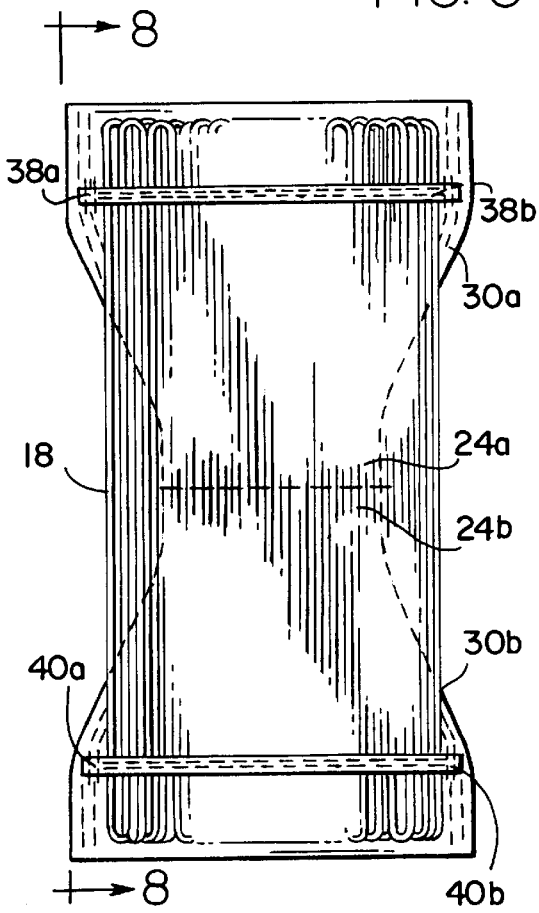
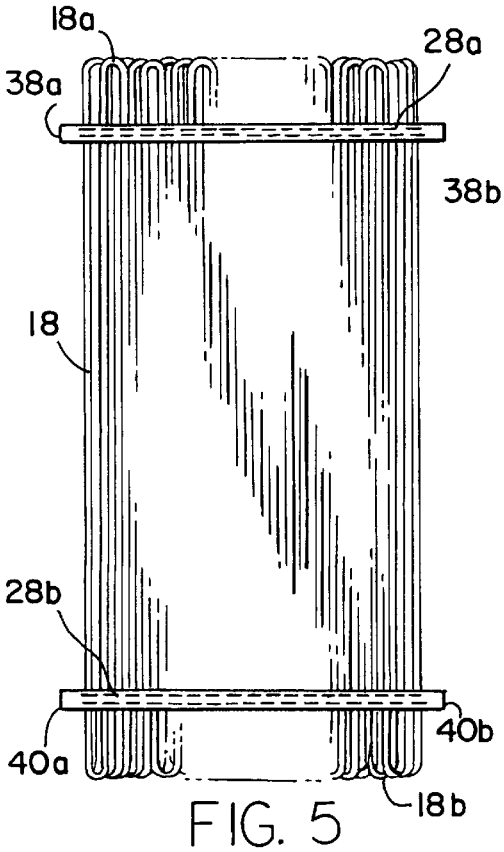
FIG. 5

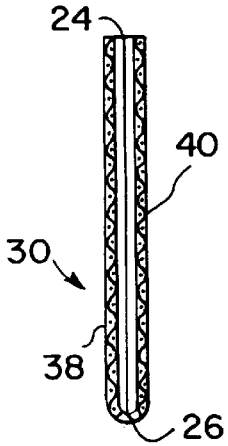
FIG. 7
FIG. 8
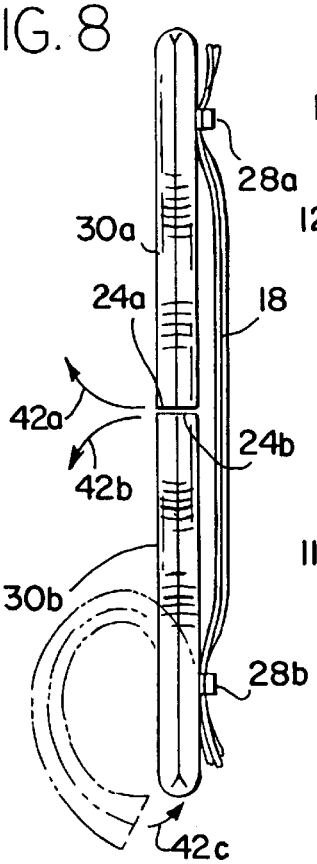
FIG. 11
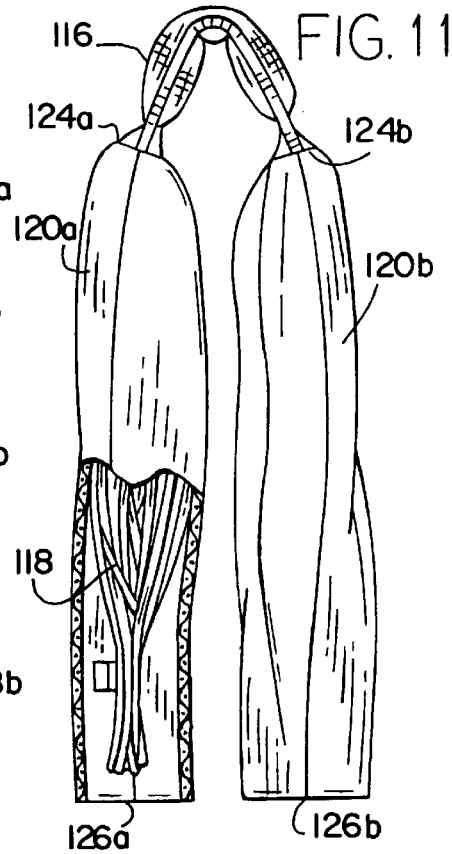
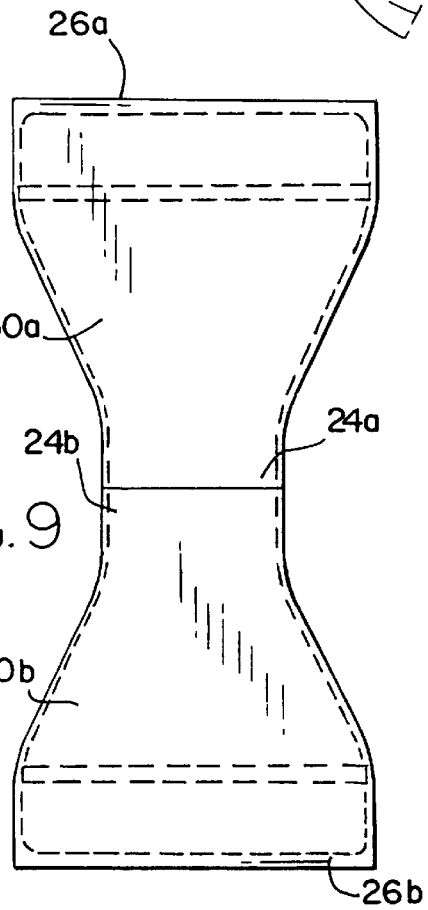
FIG. 9
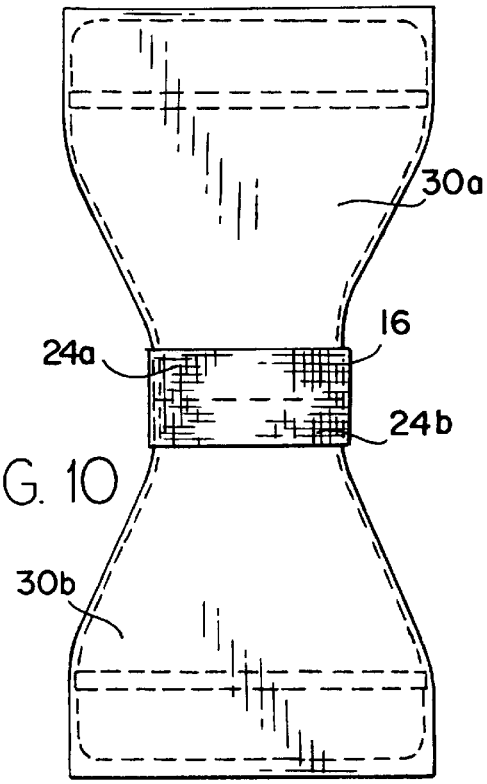
FIG. 10

FABRIC WET MOP

BACKGROUND OF THE INVENTION

This invention relates generally to mop heads that are attachable to a handle for cleaning floors and the like. More particularly, the invention relates to a fabric covering for wet mop heads.

Mops of various constructions have been used for many years for wet mopping of floors and for applying floor waxes, floor finishes and the like. A simple mop head is one where individual strands of yarn are gathered together in the middle of the mop head for attachment to a handle. These strands of yam are laid out in parallel rows, with a headband that serves as a point of attachment to the handle. After attachment to the handle by a suitable gripping means engaging the headband, the mop head is used for usual floor maintenance and is subsequently detached for laundering. Sometimes the fabric strands are sewn together near the extremities of the mop head strands to keep them in place during use and during laundering. However, over an extended period of use, the strands of yarn unravel and break apart causing the mop head to lose its effectiveness.

In order to overcome excessive fraying of cut ends, such mop heads sometimes have a looped-end design. The looped-end design ensures that there is no tangling, unraveling, or linting of yarn during use. However, the looped-ends often catch under the legs of desks, chairs, tables and the like causing inconvenience to the user and/or damage to the mop heads. In addition, due to the nature of the parallel strands of yam, voids are often left between adjacent strands of yarn resulting in areas of the floor being untouched and requiring additional passes of the mop head to clean or apply liquid to the floor.

Because wet mop heads should distribute liquid evenly on a floor during use, it is desirable that the wet mop strands have good liquid absorption in order to retain liquids and distribute them evenly over an area to be cleaned. Therefore, typical wet mop strands are composed of highly absorbent materials, such as cotton and the like. Although the cotton strands have good liquid absorbency, they tend to shrink and fray during use, thus limiting the useful life of the mop. To reduce this problem, the wet mop strands have been made of blends of rayon or other synthetic materials. However, these materials tend to cause streaks in the floor during cleaning and reduce the effectiveness of liquid pickup of the wet mop during use.

There is therefore a need for a mop head having a construction that resists tangles and frays, and also prevents the Tinting of fibers and unraveling of the mop head strands during use, especially on rough surfaces. It is also desirable that the mop head provide additional absorbency beyond that available in conventional mop head designs.

SUMMARY OF THE INVENTION

According to the present invention, an improved mop head includes a pair of fabric covering elements. The fabric covering elements are preferably created by cutting a piece of fabric material into a designated shape, folding the material in half along a center folding line and sewing the material along the sides thereof to create a fabric pouch having a closed end at the center folding line and an open end opposite the closed end. Preferably, a pair of the fabric pouches enclose strands of material (e.g. cotton) of a conventional looped-end wet mop. The strands of material are placed on top of two fabric pouches arranged so that the open ends of the fabric pouches abut each other. Preferably, two strips of banding material are attached transversely across the strands for securing the strands together and securing the strands to the fabric pouches. The fabric pouches are turned inside out so that the strands of material are enclosed within the fabric pouches. A headband is then attached around the open ends of the fabric pouches. A mop handle attaches to the headband. The fabric pouches are preferably made of terry cloth, chamois or micro-fibers, and include a front panel and a rear panel that enclose the strands of material therein. The mop head of the present invention prevents linting of fibers and the unraveling of mop strands during use on rough, anti-skid and other flooring surfaces. The design of the present invention enables the exterior of the mop head to adhere closely to the floor surface for ultimate cleaning ability. The construction further provides increased absorbency and durability allowing for fast drying of floor surfaces.

The present invention also contemplates that the fabric covering elements which enclose the strands of material have a second open end opposite the first open end, thus rendering the ends of the strands exposed.

The present invention also includes a mop head constructed with two fabric pouches having absorbent filler material inserted within the fabric pouches. The fabric pouches being constructed as described above with closed ends. The fabric pouches are preferably filled with an absorbent material such as sponge, nylon, chamois, cellulose, lambs wool, viscous fabric, polyvinyl acetate, or micro-fibers. Alternatively, the invention may be implemented with nothing inserted within the pouches. For example, empty fabric pouches being constructed as described above with a headband attached around the open ends of the fabric pouches for attachment to a mop handle.

The present invention also contemplates a method of making a fabric wet mop involving the following steps. An absorbent fabric material is cut into at least two pieces of fabric having a designated shape for forming fabric pouches having a generally trapezoidal shape. Each of the fabric pieces is folded in half along a center folding line. The folded fabric pieces are sewn along the sides thereof to form two fabric pouches having a generally trapezoidal shape with a narrow open end and a wider closed end. The two fabric pouches are then arranged so that the two narrow open ends abut each other. Next, a plurality of elongated strands of material are laid across the tops of the arranged fabric pouches. The plurality of elongated strands of material are attached to the outer edges of the fabric pouches. The fabric pouches are turned inside out so that the strands of material are enclosed within the fabric pouches. A headband is attached around the narrow open ends of the fabric pouches for attachment to a mop handle.

Various other features, objects, and advantages of the invention will be made apparent from the following detailed description and the drawings.

BRIEF DESCRIPTION OF THE DRAWINGS

FIG. 3 is a top plan view of a piece of fabric material used in creating a fabric pouch for covering the strands of a looped-end wet mop.

FIG. 4 is a top plan view of the piece of fabric material of FIG. 3 folded in half and sewn along the sides thereof to form a fabric pouch.

FIG. 5 is a top plan view of the strands of a looped-end wet mop used in constructing a first embodiment of the fabric wet mop.

FIG. 6 is a top plan view of the looped-end strands of FIG. 5 being laid across the top of two fabric pouches and attached to the outer edges of the fabric pouches.

FIG. 7 is a cross sectional view of the fabric pouch taken along line 7—7 of FIG. 4.

FIG. 8 is a side elevational view of the looped-end strands and fabric pouches taken along line 8—8 of FIG. 6, prior to turning the fabric pouches inside out to enclose the looped-end strands within the fabric pouches.

FIG. 9 is a top plan view of the fabric wet mop prior to attachment of a headband.

FIG. 10 is a top plan view of the fabric wet mop having a headband attached to the center portion of the mop head.

FIG. 11 is a side elevational view similar to FIG. 2 showing the strands of a looped-end wet mop enclosed within a fabric covering.

DETAILED DESCRIPTION OF THE INVENTION

Figure 1:
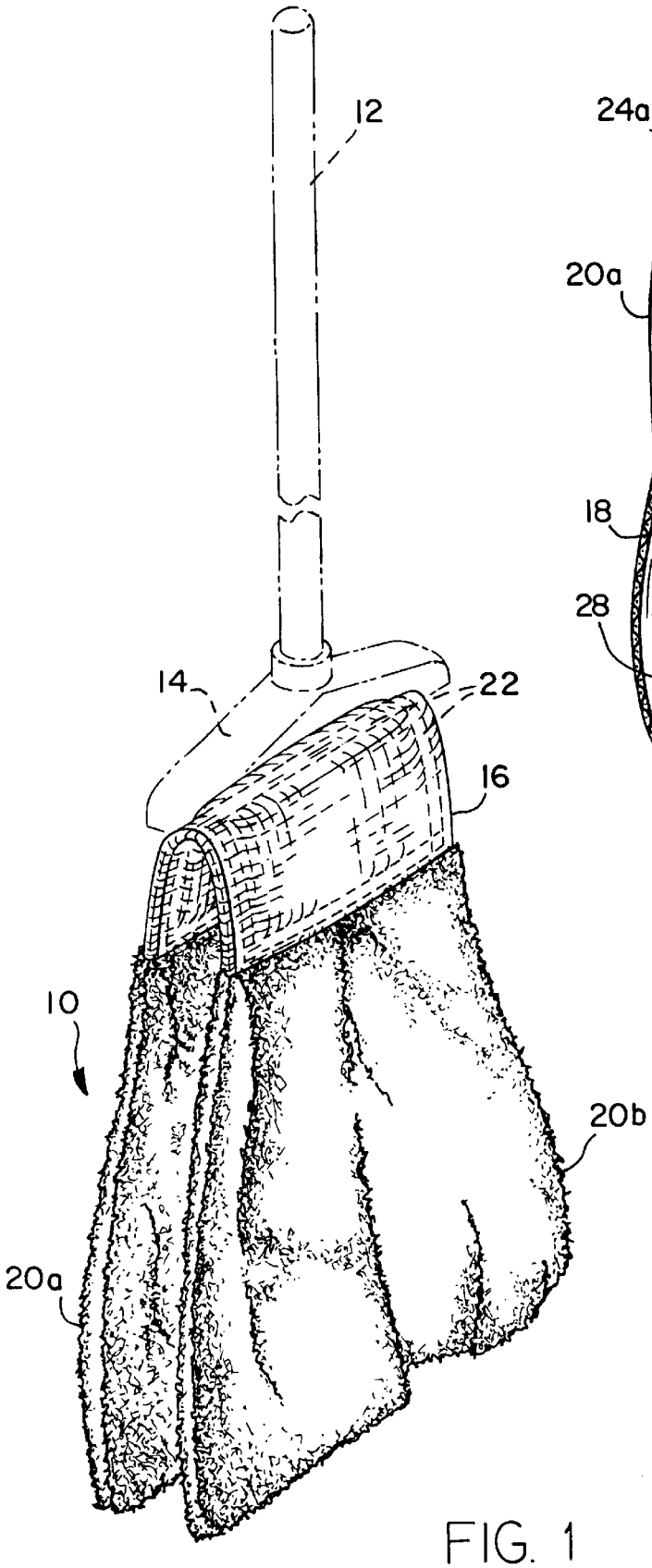
FIG. 1 is a perspective view of a fabric wet mop constructed in accordance with the present invention.

Referring now to the drawings, FIGS. 1–11 illustrate a fabric wet mop and a method of constructing the fabric wet mop in accordance with the present invention. In particular, FIG. 1 shows a mop head 10 constructed in accordance with the present invention and primarily designed for use as a wet mop. The mop head 10 is attached to a mop handle 12 by a gripping member 14 which attaches to a headband 16 encircling the center portion of the mop head 10. Extending downwardly from each end of the headband 16 is the main body of the mop head which is comprised of two generally trapezoidal shaped sections of fabric covering the strands of a typical looped-end wet mop. The main body of the mop head 10 is made of fabric which covers the strands 18, FIG. 2, of a typical looped-end wet mop. The two generally trapezoidal shaped fabric covering elements 20*a*, 20*b* are placed over each end of the looped-end wet mop and attached thereto by sewing the headband 16 around the center portion of the mop head 10. The headband 16 is formed by wrapping a strip of material, such as polyester mesh, around the center portion of the mop head and stitching it to the fabric covering elements 20*a*, 20*b* and strands 18 enclosed therein. The headband 16 is stitched along its entire perimeter and transversely across the center of the headband using a double lock stitch 22 as shown in FIG. 1

Figure 2:
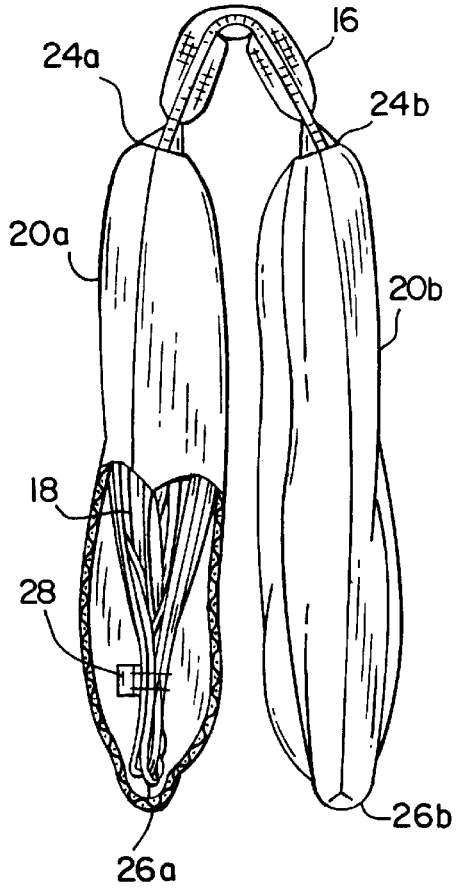
FIG. 2 is a side elevational view of the fabric wet mop partially broken away showing the strands of a looped-end wet mop inside a pair of fabric pouches.

FIG. 2 illustrates a side elevational view of the mop head partially broken away showing the strands 18 of a typical looped-end wet mop enclosed within the fabric covering elements 20*a*, 20*b*. The fabric covering elements 20*a*, 20*b* are sewn together to form fabric pouches having an open end 24*a*, 24*b* attached to the headband 16 and a closed end 26*a*, 26*b* enclosing the mop strands 18. A pair of strips of banding material 28*a*, 28*b* (see FIGS. 5 and 8) are sewn to the strands 18 near the looped-ends to keep the strands secure and in place during use. The bands 28*a*, 28*b* are bar-tack stitched to the inside of the fabric covering elements 20*a*, 20*b* to keep the strands 18 spread out and in place within the fabric covering elements.

The fabric covering elements 20*a*, 20*b* are preferably made of terry cloth, but may include cotton, rayon, micro-fibers or other fabrics to increase the effectiveness and absorbency of the mop, along with eliminating tangling, unraveling, and linting of the strands during use.

FIGS. 3–10 illustrate a method of constructing the mop head of FIGS. 1 and 2 in accordance with the present invention. FIG. 3 shows a first piece of fabric material 32 which is used to enclose one end of a looped-end wet mop. As mentioned earlier, the fabric material is preferably made of an absorbent material, such as terry cloth. The piece of fabric 32 is cut in an oblong shape to create a generally trapezoidal shaped covering element when folded along a central folding line 34 extending transversely across the center of the piece of fabric 32.

FIG. 4 illustrates the oblong piece of fabric material 32 folded in half along folding line 34 to create a generally trapezoidal shaped covering element. The covering element is then sewn along the sides thereof using a double lock stitch shown as dotted lines 36 in FIG. 4 to create a fabric pouch 30. The fabric pouch 30 includes a narrow open end 24 at the top for insertion of one end of the strands of a looped-end wet mop. The pouch 30 also includes a wider closed end 26 at the bottom for enclosing the strands of a looped-end wet mop. A cross-sectional view of the fabric pouch 30 is shown in FIG. 7. The trapezoidal shape of the pouch 30 ensures that the open end 24 is always narrower than the closed end 26. FIG. 7 shows the fabric pouch 30 having an open end 24, a closed end 26, a front panel 38 and a rear panel 40 for enclosing the strands 18 of a looped-end wet mop.

The strands of a typical looped-end wet mop are shown in FIG. 5. The looped-end wet mop is constructed with one continuous strand that is wound back and forth to create a plurality of elongated strands 18 that extend longitudinally in parallel rows with looped-ends. The plurality of elongated strands 18 include a first plurality of looped-ends 18*a* and a second plurality of looped-ends 18*b* at opposite ends thereof. To keep the plurality of elongated strands 18 in place, two strips of banding material 28*a*, 28*b* are sewn to the strands inwardly from the first and second plurality of looped-ends 18*a*, 18*b* and extend transversely across at least one side of the strands. The bands 28*a*, 28*b* include tabs 38*a*, 38*b* and 40*a*, 40*b* extending outwardly from the strands on each side for attaching the strands to the inside of the pouches 30*a*, 30*b*. The bands 28*a*, 28*b* keep the strands 18 in place and allow the mop head to fan out and cover more area during use.

The steps of FIGS. 3 and 4 are repeated for a second piece of fabric material to provide a fabric pouch for each end of the looped-end wet mop. FIG. 6 illustrates the next step in creating the fabric covered mop head. As shown in FIG. 6, the plurality of elongated strands 18 are laid on top of two fabric pouches 30*a*, 30*b* which have been laid end to end with the narrow open ends 24*a*, 24*b* adjoining each other. The tabs 38*a*, 38*b* and 40*a*, 40*b* at the outer ends of the bands 28*a*, 28*b* extending outwardly from the strands are bar-tack stitched to the outer ends of the fabric pouches 30*a*, 30*b*. Bar-tack stitching the tabs 38*a*, 38*b* and 40*a*, 40*b* of the bands to the outer edges of the fabric pouches 30*a*, 30*b* keep the strands 18 spread out and in place during use. A side elevational view of the strands 18 lying on top of the two pouches 30*a*, 30*b* is shown in FIG. 8.

FIG. 8 illustrates the next step in the method of constructing the mop head of the present invention. This step involves turning the fabric pouches 30*a*, 30*b* inside out along the open ends 24*a*, 24*b* thereof so that the plurality of elongated strands 18 are enclosed inside of the fabric pouches 30*a*,

30*b*. In this step, it is easiest to turn one pouch inside out at a time as demonstrated by arrows 42*a*, 42*b* and 42*c*.

FIG. 9 illustrates the end result of turning the two fabric pouches 30*a*, 30*b* inside out and having the plurality of elongated strands 18 located inside the two fabric pouches 30*a*, 30*b*. The fabric pouches 30*a*, 30*b* are arranged so that the narrow open ends 24*a*, 24*b* adjoin each other, creating a fantail arrangement with the wider closed ends 26*a*, 26*b* extending outwardly from the narrow open ends in a flared relationship.

The next step of the method is shown in FIG. 10. A headband 16 is attached around the center portion of the mop head where the two narrow open ends 24*a*, 24*b* of the fabric pouches 30*a*, 30*b* come together. The open ends 24*a*, 24*b* of the fabric pouches 30*a*, 30*b* may overlap prior to attachment of the headband 16. The headband 16 is formed by wrapping a strip of material, such as polyester mesh around the center portion of the mop head enclosing the narrow open ends 24*a*, 24*b* of the fabric pouches 30*a*, 30*b* and stitching the headband 16 to the fabric covering and strands within the fabric covering to form a unitary construction. The open ends 24*a*, 24*b* of the fabric pouches 30*a*, 30*b* are stitched together with one or more rows of stitching around the perimeter of the headband 16 and transversely across the middle of the headband as shown in FIG. 1. The headband 16 is sewn in place to securely attach the fabric pouches 30*a*, 30*b* together at the center portion of the mop head. The mop head 10 may then be attached to a gripping member 14 of a mop handle 12 as shown in FIG. 1

As mentioned previously, FIG. 2 illustrates a plurality of elongated strands 18 of a looped-end wet mop enclosed within two fabric covering elements 20*a*, 20*b* having a closed end 26 at the bottom thereof for enclosing the strands 18 of the looped-end wet mop. As an alternative design, the present invention contemplates having two fabric covering elements 120*a*, 120*b* covering the strands 118 of a looped-end wet mop as shown in FIG. 11. This design is very similar to the first embodiment except that the fabric covering elements 120*a*, 120*b* are open at the bottom. Each of the fabric covering elements 120*a*, 120*b* in FIG. 11 have a first open end 124*a*, 124*b* at the top and a second open end 126*a*, 126*b* at the bottom.

Each of the fabric covering elements 120*a*, 120*b* in the embodiment shown in FIG. 11 may be constructed by sewing two generally trapezoidal shaped pieces of fabric together along the sides thereof to create a fabric covering element having a first open end at the top thereof for inserting a plurality of elongated strands therein and a second open end at the bottom thereof to create a fabric covered mop head. Alternatively, the configuration shown in FIG. 11 may be constructed in the same manner as shown in FIGS. 3–4 except that the piece of fabric material 32 is cut along folding line 34 to create two pieces of fabric material that are sewn together along the sides thereof. The fabric covering elements 120*a*, 120*b* covering the plurality of elongated strands are arranged so that the first open ends 124*a*, 124*b* adjoin each other, creating a fantail arrangement with the second open ends 126*a*, 126*b* extending outwardly from the first open ends 124*a*, 124*b* in a flared relationship. A headband 116 is attached around the center portion of the mop head where the two first open ends 124*a*, 124*b* adjoin each other. The headband 116 is stitched to the fabric covering elements 120*a*, 120*b* and to the plurality of elongated strands 118 enclosed therein to form a mop head having a unitary construction.

Figure 12:
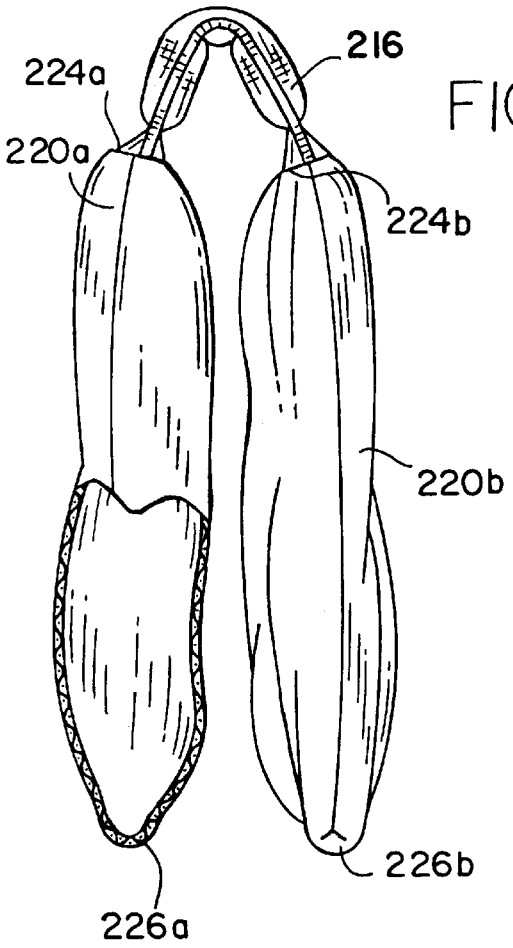
FIG. 12 is a side elevational view of a fabric wet mop with nothing inside a pair of fabric mopping elements.

FIG. 12 shows an alternative construction of a fabric wet mop constructed in accordance with the present invention. In this construction, the fabric wet mop is comprised of two fabric mopping elements 220*a*, 220*b* attached to a headband 216 for attachment to a mop handle. The fabric mopping elements 220*a*, 220*b* are preferably made of an absorbent fabric such as terry cloth, but may also include cotton, rayon, micro-fibers and other absorbent fabrics. The fabric mopping elements 220*a*, 220*b* are empty.

The fabric mopping elements 220*a*, 220*b* are generally trapezoidal shaped with an open end 224*a*, 224*b* at the top, and a closed end 226*a*, 226*b* at the bottom. Each fabric mopping element 220*a*, 220*b* is preferably constructed in a similar manner to that shown in FIGS. 3 and 4. The main difference from the construction shown in FIGS. 1–11 is that the fabric mopping elements 220*a*, 220*b* do not enclose or cover anything. The mop head consists entirely of two fabric mopping elements 220*a*, 220*b* attached to the ends of a headband 216.

Figure 13:
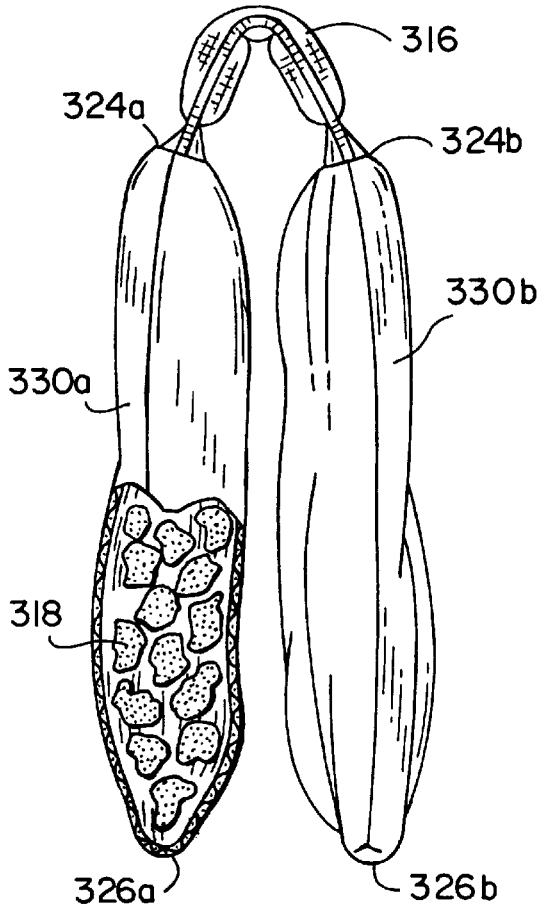
FIG. 13 is a side elevational view of a fabric wet mop with filler material inside a pair of fabric pouches.

FIG. 13 shows another alternative construction of a fabric wet mop. In this construction, a plurality of filler material pieces 318 are added to the inside of two fabric pouches 330*a*, 330*b*. The filler material pieces 318 may be comprised of sponge-type material, nylon, chamois, cellulose, lambs wool, viscous fabric, polyvinyl acetate, or micro-fibers. The fabric pouches 330*a*, 330*b* should be filled with enough filler material 318 so that the mop head maintains a uniform shape during use. The fabric pouches 330*a*, 330*b* are created in a similar manner to that shown in FIGS. 3 and 4. The pouches 330*a*, 330*b* are turned inside out and the filler material 318 is added to the inside of the pouches. Each of the fabric pouches 330*a*, 330*b* include an open end 324*a*, 324*b* at the top for insertion of filler material 318 and a closed end 326*a*, 326*b* at the bottom for maintaining the filler material within the pouches. Once the two fabric pouches 330*a*, 330*b* have been filled with filler material 318, the open ends of the pouches 324*a*, 324*b* are brought together and arranged so that the open ends 324*a*, 324*b* adjoin each other. A headband 316 is sewn around the center portion of the mop head where the open ends 324*a*, 324*b* of the fabric pouches 330*a*, 330*b* come together to form a mop head having a unitary construction.

It is recognized that other equivalents, alternatives, and modifications aside from those expressly stated, are possible and within the scope of the appended claims.

We claim:

1. An improved mop head comprising:

a plurality of elongated strands of material extending longitudinally in rows with a first plurality of ends and a second plurality of ends at opposite ends thereof;

two strips of banding material attached traversely across the plurality of elongated strands of material, a first strip attached to the strands inwardly from the first plurality of ends and a second strip attached to the strands inwardly from the second plurality of ends;

a pair of fabric covering elements each having a first end and a second end and each having a front panel and a rear panel enclosing the plurality of elongated strands of material therein, wherein the first end defines an opening that surrounds a center portion of the elongated strands of material between the first plurality of ends and the second plurality of ends, and wherein the second end encloses the respective plurality of ends; and a headband attached to the first ends of the pair of fabric covering elements which surrounds the center portion of the plurality of elongated strands of material and facilitates attachment of the mop head to a mop handle.

2. The improved mop head of claim 1 wherein the second ends of the fabric covering elements are closed.

3. The improved mop head of claim 1 wherein the second ends of the fabric covering elements are open.

4. The improved mop head of claim 1 wherein the headband has a first end and a second end, and a first of the fabric covering elements extends downwardly and outwardly from the first end of the headband and a second of the fabric covering elements extends downwardly and outwardly from the second end of the headband.

5. The improved mop head of claim 1 wherein the first plurality of ends are looped-ends and the second plurality of ends are looped-ends.

6. The improved mop head of claim 1 wherein the strips of banding material include at least one tab extending outwardly therefrom for attachment to the fabric covering elements.

7. The improved mop head of claim 1 wherein the fabric covering elements are made of terry cloth.

8. The improved mop head of claim 1 wherein the fabric covering elements are made of micro-fibers.

9. The improved mop head of claim 1 wherein the fabric covering elements are made of chamois.

10. The improved mop head of claim 1 wherein the fabric covering elements have a generally trapezoidal shape with a narrow open end and a wider closed end.

11. The improved mop head of claim 1 wherein each fabric covering element comprises a piece of fabric material folded in half along a center folding line and sewn together along the sides thereof to form a fabric pouch having an open end and a closed end for enclosing the plurality of elongated strands of material therein.

12. A mop head comprising:

two pieces of fabric material having a designated shape;

a pair of fabric pouches formed from the two pieces of fabric material by folding the fabric material in half along a center folding line and sewing the material together along the sides thereof, wherein each of the fabric pouches includes a front panel and a rear panel with an open end and a closed end; and a headband attached around the open ends of the pair of fabric pouches for attachment to a mop handle.

13. The mop head of claim 12 wherein the headband includes a first end and a second end with a first fabric pouch extending downwardly and outwardly from the first end of the headband and a second fabric pouch extending downwardly and outwardly from the second end of the headband.

14. The mop head of claim 12 further comprising a plurality of filler material pieces enclosed within the pair of fabric pouches.

15. The mop head of claim 14 wherein the filler material pieces are absorbent.

16. The mop head of claim 15 wherein the fabric pouches are filled with enough filler material pieces to maintain a uniform shape during use.

17. The mop head of claim 12 wherein the fabric pouches are made of terry cloth.

* * * * *